US011594813B2

(12) United States Patent
Holzleitner et al.

(10) Patent No.: US 11,594,813 B2
(45) Date of Patent: Feb. 28, 2023

(54) METHOD FOR PRODUCING A LAYERED STRUCTURE IN A MULTI-COMPONENT PROCESS

(71) Applicant: Bayerische Motoren Werke Aktiengesellschaft, Munich (DE)

(72) Inventors: Jochen Holzleitner, Ergolding (DE); Manuel Schwarz, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/320,340

(22) Filed: May 14, 2021

(65) Prior Publication Data

US 2021/0376458 A1 Dec. 2, 2021

(30) Foreign Application Priority Data

May 28, 2020 (DE) ..... 10 2020 114 258.7

(51) Int. Cl.
*H01Q 1/42* (2006.01)
*B05D 3/00* (2006.01)
*B05D 1/02* (2006.01)

(52) U.S. Cl.
CPC ..... *H01Q 1/422* (2013.01); *B05D 1/02* (2013.01); *B05D 3/007* (2013.01)

(58) Field of Classification Search
None
See application file for complete search history.

(56) References Cited

U.S. PATENT DOCUMENTS

2018/0090831 A1 3/2018 Frayer et al.
2021/0316671 A1* 10/2021 Holzleitner ..... B29C 45/1751

FOREIGN PATENT DOCUMENTS

DE 101 56 699 A1 6/2003
DE 10156699 A1 * 6/2003 ..... H01Q 1/3233
DE 10 2018 213 972 A1 2/2020
DE 102018213972 A1 * 2/2020 ..... B29C 45/16
EP 2 640 609 B1 11/2016
WO WO 2019/043202 A1 3/2019
WO WO 2019/130033 A1 7/2019

OTHER PUBLICATIONS

German-language Search Report issued in German Application No. 10 2020 114 258.7 dated Nov. 30, 2020 with partial English translation (12 pages).

* cited by examiner

*Primary Examiner* — Michael P. Rodriguez
(74) *Attorney, Agent, or Firm* — Crowell & Moring LLP

(57) ABSTRACT

A method for producing a layered structure in a multi-component process includes the steps of: generating a basic substrate composed of a transparent plastic, in particular of polycarbonate, in a first manufacturing step, and coating the basic substrate with a transparent resin layer, in particular composed of polyurethane, in a second manufacturing step.

11 Claims, 1 Drawing Sheet

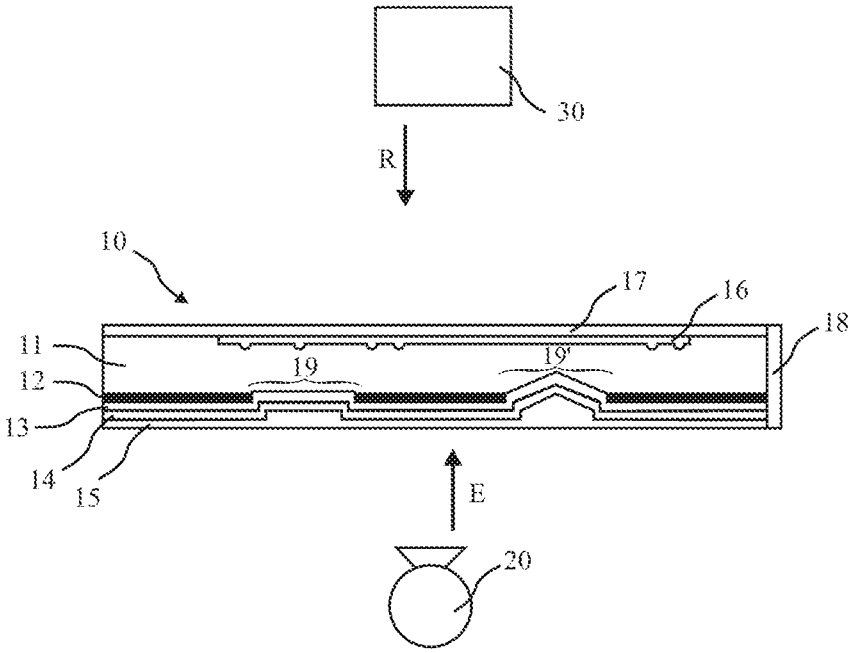
30
R
10
17
16
18
11
12
13
14
15
19
19'
E
20

METHOD FOR PRODUCING A LAYERED STRUCTURE IN A MULTI-COMPONENT PROCESS

CROSS REFERENCE TO RELATED APPLICATION

This application claims priority under 35 U.S.C. § 119 from German Patent Application No. 10 2020 114 258.7, filed May 28, 2020, the entire disclosure of which is herein expressly incorporated by reference.

BACKGROUND AND SUMMARY OF THE INVENTION

The present invention relates to a method for producing a layered structure in a multi-component process.

In contemporary vehicle construction, efforts have been made for some time now to realize self-driven vehicles. In order to sense objects that are located in the vehicle surroundings, radar-based systems are used. Current radomes (coverings in front of the front radar of the vehicle) consist of a multi-shell construction, which is generally composed of at least two injection-molded parts that have to be joined together. The two individual parts are then joined (for example by adhesive bonding) to form an assembly which, in the final state, has to be of tight design with respect to the influence of media. In the case of these components, a heating device is attached to the rear side in the non-visible region and must then heat the front side of the component through two plastics shells and the air gap, which leads to increased energy consumption and/or poorer heating performance.

With regard to radar function, the current design of the radomes with a double-shell construction and an air gap between the two shells has dependencies on temperature, moisture, etc., for the detection of objects.

EP 2 640 609 B1 shows a radome of the generic type for vehicles.

Proceeding from this prior art, the invention has the object of providing a method for producing a layered structure that is particularly suitable for the use as a radome.

In order to achieve this object, the invention teaches a method for producing a layered structure in a multi-component process, having the steps of:

- generating a basic substrate composed of a transparent plastic, in particular of polycarbonate, in a first manufacturing step, and
- coating the basic substrate with a transparent resin layer, in particular composed of polyurethane, in a second manufacturing step. The transparent resin layer can in this case have self-healing properties. The resin layer preferably constitutes an outer side of the layered structure.

In the context of this application, a self-healing layer is a resin system which, in the case of scratches or spots, has a self-healing effect as a result of the action of heat or time, by way of which self-healing effect the scratches are closed again or spots disappear. This effect is produced, for example, by way of physical bonds (for example hydrogen bonds) in the resin layer, which are separated in the event of damage (for example scratches) and subsequently form back again as long as no material-removing damage takes place. This affords the advantage of increased scratch resistance, by way of which a consistently unrestricted function of the radar system is maintained, even in the event of stone chipping or similar loadings.

The wall thickness of the basic substrate in conjunction with the transparent resin layer can in this case be selected such that the wall thickness constitutes a multiple of the wavelength in the material for the radar-relevant frequency range. It is thus possible to generate an attenuation minimum for radar waves of a specific frequency. The resin layer can have a similar or identical radar transparency as the basic substrate in order to minimize reflections in the boundary layer. The resin layer can have a layer thickness in the range from 0.5 mm to 2.0 mm. The layer thickness of the resin layer preferably lies in a range from 0.5 mm to 1.0 mm for realization of a shorter cycle time and reduction of possible surface waviness. Compared with a double-shell design, the multi-layered component produced according to the method, in the use as a radome, provides an increased design freedom, a more favorable tolerance situation and improved radar and heating performance.

After the basic substrate has been generated, the basic substrate can remain in the production tool, with the coating of the basic substrate taking place while the basic substrate is located in the production tool. In this way, additional handling steps are omitted, which has a positive effect on quality, in particular in terms of tolerances, contaminants, damage.

A transparent heating film can be integrated between the basic substrate and the resin layer. The heating film can preferably be composed of the same basic material as the basic substrate which is generated in the first production step. This heating film has a predefined wire layout, the wires being deposited on the film surface and being at least partially sunk into the film, for example by means of vibration methods. If these wires, which have a defined electrical resistance, are energized, the heat required for heating the radome is generated. In this case, the wires are arranged such that the component surface is heated homogeneously over its entire area.

The heating film can be applied to a surface of the basic substrate prior to the coating operation of the basic substrate and can subsequently be covered over its entire area with the resin layer in a flooding process, the heating film being located so as to be completely embedded between the resin layer and the basic substrate after the coating operation. The resin layer in this case forms a front side of the layered component. As a result, optimized heating performance of the front component side is ensured and visible effects of the heating film on the visible component side are avoided.

Furthermore, a lacquer layer can be applied directly to a surface of the basic substrate, said surface facing away from the resin layer. The lacquer layer can have a defined radar transparency, which is preferably identical to the radar transparency of the basic substrate and/or of the resin layer, and is applied in layer thicknesses of 5 μm to 50 μm.

According to a first variant of the method, the lacquer layer can initially be applied over the entire area of that surface of the basic substrate which faces away from the resin layer, and can subsequently be removed at least in certain portions by means of laser ablation. The ablation of the lacquer layer can be effected both in portions in which the finished component has wall thickness variations and in portions with a constant wall thickness. The former is the case in particular in the regions in which a three-dimensional pattern is intended to be generated.

According to a second variant of the method, before a lacquer layer is applied, a mask can be applied to certain portions of a surface of the basic substrate, said surface facing away from the resin layer, the lacquer layer being applied to the mask in masked regions and being applied directly to the surface of the basic substrate in non-masked regions. Masked regions are provided in particular in the regions in which a two-dimensional or three-dimensional pattern is intended to be generated.

According to a third variant of the method, a lacquer layer can be applied at least to one of the sides of the basic substrate, said sides facing away from the resin layer, by means of a printing method, in particular by means of inkjet printing, digital printing, screen printing, the lacquer layer being applied to only certain portions of the surface of the basic substrate and regions with lacquer layer and regions without lacquer layer thereby being produced on this surface. As a result, the rear side of the basic substrate is selectively coated, and a desired pattern is generated directly during the application of the first color. As a result, selective layer ablation by means of laser is no longer necessary. Regions without lacquer layer are provided in particular at points where a two-dimensional or three-dimensional pattern is intended to be generated.

According to a fourth variant, for generation of the first color layer, the lacquer layer can be generated by application of a hot-stamping film. It is necessary for the layer thickness and the material selection of the hot-stamping film to be selected so as to be optimized for the radar performance of the entire component.

According to a fifth variant, for generation of the first color layer, a printed or coated film can be back-molded, directly during the production of the basic substrate, onto the component surface lying opposite the additional resin layer. Here, prior to the generation of the basic substrate, the printed or coated color layer is introduced into the production tool in which the basic substrate is generated. Thereafter, the printed or coated film is back-molded with the basic substrate material. In this way, it is likewise possible for a two-dimensional or three-dimensional pattern to be generated.

Furthermore, after the lacquer layer has been generated, a transparent adhesion-promoter layer can be applied to the lacquer layer, in particular in a layer thickness of 5 μm to 50 μm. The adhesion-promoter layer serves to improve the adhesion of the subsequent decorative layer, and can be implemented either with or without matting agents in order to influence the visual effect of the subsequent decorative layer, for example high gloss or silk-matt effect. The composition and layer thickness of the transparent adhesion-promoter layer are also optimized with regard to radar transparency.

A decorative layer composed of a semiconductor or composed of a semiconductor in combination with a conductor can be applied to the transparent adhesion-promoter layer by means of physical vapor deposition, in particular by means of sputtering. A coating by means of chemical vapor deposition is also possible. This decorative layer provides a metallic appearance of the second color and is at the same time radar-transparent. The layer thickness of this decorative layer is between 10 nm and 300 nm, preferably between 15 nm and 80 nm, for a cost-effective representation of the target colors. The layer is generated from silicon, germanium, boron, selenium, tellurium, arsenic, antimony or from mixtures of these elements. Furthermore, for representation of a desired color of the decorative layer, a small amount of a metal, in particular chromium, can be added to the sputtered-on semiconductor material. In order to guarantee radar transparency, this proportion should not exceed a proportion of 10% by volume.

A non-transparent topcoat can be applied to the decorative layer by means of spraying methods. The topcoat can have a layer thickness of 5 μm to 150 μm and can be radar-transparent in such a way that its layer thickness is likewise optimized for the radar performance. This topcoat is a final layer and is at the same used to seal the rear side of the component. The topcoat protects the rest of the layers against environmental influences, and also protects against undesired shining through/illumination of the component from the rear side. If such shining through or illumination is desired, this topcoat can correspondingly be of transparent design.

Furthermore, the end-side surfaces of the basic substrate which is provided with one or more layers can be sealed with a resin.

Instead of the coating of the adhesion-promotor layer in combination with the decorative sputter layer and the final topcoat, a further decorative lacquer layer or a print in the second color can be applied in order to generate the second color. It is to be ensured in this case that the second color is radar-transparent and adheres sufficiently to the layer lying beneath it.

With suitable selection of the second color layer, it is potentially possible for the adhesion-promoter layer and/or a final topcoat to be dispensed with.

In a further aspect, the invention relates to a layered structure having a basic substrate composed of a transparent plastic, in particular of polycarbonate, and a coating composed of a transparent resin layer, in particular of polyurethane, on the basic substrate.

A transparent heating film can be integrated between the basic substrate and the resin layer.

Furthermore, the heating film can be covered over its entire area with the resin layer, the heating film being completely embedded between the resin layer and the basic substrate.

Furthermore, a lacquer layer can be provided directly on a surface of the basic substrate, said surface facing away from the resin layer.

A transparent adhesion-promoter layer can be provided on the lacquer layer, in particular in a layer thickness of 5 μm to 50 μm.

A decorative layer composed of a semiconductor can be applied to the transparent adhesion-promoter layer by means of physical vapor deposition, in particular by means of sputtering.

A non-transparent topcoat can be applied to the decorative layer by means of spraying methods.

The end-side surfaces of the basic substrate, which is provided with one or more layers, including the basic substrate, are sealed with a resin.

The advantages of the invention will be summarized below. Advantages that are mentioned with respect to the method also apply for the layered structure, and vice versa.

The production of a layered structure in a multi-component process makes it possible to generate a multi-layered component which is used as a front kidney grille or a front grille with an integrated radome function. As a result of this design, the component can be used to ensure a significantly better radar functionality with simultaneous optimization of the heating function. In addition thereto, a separate component is saved, a unique 3D effect is generated, and a particular design with a depth effect is made possible. A variation of the patterns, and also a customization, is made possible by the selective ablation of the first lacquer layer. With this method, a radome can be integrated in a complete front grille/a front kidney grille of a vehicle, and thus a seamless visual appearance can be represented. A reduction of joins on the outer skin of the vehicle also improves the aerodynamic properties of the vehicle and also reduces the fuel consumption. All of the layers are in each case optimized with respect to layer thickness for the best radar transparency and generate, in the overall assembly, a sufficient adhesion over the entire service life of the vehicle. The production method of the basic substrate is in this case selected such that it is not possible to identify the component separation of the film, with the size of the integrated film being smaller than the complete component. In the region of the radar viewing field, the finished blank (basic substrate, resin layer and heating device) has a constant wall thickness. Outside of the radar viewing field, this design can be used to vary the rear-side wall thickness of the plastics component such that patterns with a 3D depth effect are produced which, on account of the plastics technology-related design and the resin layer on the outer side, do not lead to impairment of the class A surface of the component. The wall thickness of the basic substrate can be varied in dependence on the starting wall thickness, for example a wall thickness variation of up to 3.0 mm in the case of a starting wall thickness of 5.2 mm. The wall thickness of the resin layer on the front side of the component must in this case be selected such that it is at least 0.5 mm. As a result of this wall thickness, on the one hand, it is possible for shrinkage effects to be concealed, and, on the other hand, the resin layer is selected such that, in the case of scratches or spots, it has a self-healing effect as a result of the action of heat or time.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 shows a section through a layered structure according to an embodiment of the invention.

DETAILED DESCRIPTION OF THE DRAWING

FIG. 1 shows a sectional view through a layered structure 10 which was produced in a multi-component process and which is used as a radome. The radome 10 can be used as an external cladding part of a vehicle and conceals a radar sensor 20 which is arranged in the interior of the vehicle. The radar sensor 20, which is arranged behind the radome 10, is not visible from an outer side of the vehicle.

The radome 10 has a basic substrate 11. A resin layer 17 is applied to a surface of the basic substrate 11, said surface facing away from the radar sensor 20. A heating film 16 is arranged at least in certain portions between the resin layer 17 and the basic substrate 11. The heating film 16 can be used to control the temperature, in particular heat, of the outer surface of the resin layer 17, and thus of the radome 10, in order to remove precipitation such as rainwater, ice or snow. Furthermore, the heating film can be actuated such that, in the resin layer 17, a temperature is induced at which a self-healing process is triggered, by way of which damage in the surface of the resin layer, such as scratches or pores, is closed.

A lacquer layer 12 is applied to the rear side of the substrate 11, that is to say to a surface of the substrate 11 that faces toward the radar sensor 20. This lacquer layer has apertures or cutouts 19, 19' which are arranged in the form of a pattern. By means of the lacquer layer 12, it is possible to generate an outwardly visible coloring of the radome. An adhesion-promoter layer 13 is applied to the surface of the lacquer layer 12, said surface facing away from the basic substrate 11. A decorative layer 14 is applied to the adhesion-promoter layer, said decorative layer being visible from an outer side of the vehicle or from an outer side of the radome 10 through the cutouts 19, 19' in the lacquer layer 12. A two-colored effect of the radome 10 can thus be generated. A final layer 15 composed of a non-transparent topcoat is applied to a side of the decorative layer 14, said side facing toward the radar sensor 20. The end sides of the layers and of the basic substrate can be sealed with a resin 18. The resin 18 preferably completely surrounds the radome 10 or the basic substrate 11 and all of the layers 12, 13, 14, 15 and 17 in a circumferential direction. In order to avoid stray light, the resin 18 can preferably be formed from black material.

The functioning of the radome 10 will be briefly explained below. The radar sensor 20 emits radar waves in an emission direction E. These radar waves penetrate the radome 10 from a rear side, beginning with the non-transparent topcoat layer 15 and ending with the resin layer 17. After exiting the radome through the resin layer 17, the radar waves impinge on an object 30 that is located in front of the radome or in front of the vehicle. The radar waves are reflected on this object 30 and penetrate through the radome in a reflection direction R. They pass through the radome in the reverse direction, this time from the resin layer 17 to the topcoat 15. After exiting the radome 10 through the topcoat 15, said radar waves are captured again by the radar sensor 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a layered structure in a multi-component process, wherein the layered structure is a radome of a self-driven vehicle, comprising:

generating a basic substrate composed of a transparent plastic, in a first manufacturing step;

coating the basic substrate with a transparent resin layer, in a second manufacturing step; and selecting a wall thickness of the basic substrate in conjunction with the transparent resin layer such that the wall thickness constitutes a multiple of a wavelength in the material of the basic substrate for a radar frequency range, wherein the transparent resin layer has a radar transparency which is identical to a radar transparency of the basic substrate, wherein a transparent heating film is integrated between the basic substrate and the resin layer and wherein the heating film is applied to a surface of the basic substrate prior to the coating operation of the basic substrate and is subsequently covered over its entire area with the resin layer in a flooding process, the heating film being located so as to be completely embedded between the resin layer and the basic substrate after the coating operation.

2. The method according to claim 1, wherein the transparent plastic is polycarbonate, and the transparent resin layer is composed of polyurethane.

3. The method according to claim 1, wherein after the basic substrate has been generated, the basic substrate remains in a production tool, and the coating of the basic substrate takes place while the basic substrate is located in the production tool.

4. The method according to claim 1, wherein a lacquer layer is applied directly to a surface of the basic substrate, said surface facing away from the resin layer.

5. The method according to claim 4, wherein the lacquer layer is initially applied over the entire area of that surface of the basic substrate which faces away from the resin layer, and is subsequently removed, at least in certain portions, by way of laser ablation or by way of mechanical machining.

6. The method according to claim 4, wherein, before the lacquer layer is applied, a mask is applied to at least certain portions of a surface of the basic substrate, said surface facing away from the resin layer, and the lacquer layer is applied to the mask in masked regions and is applied directly to the surface of the basic substrate in non-masked regions.

7. The method according to claim 4, wherein the lacquer layer is applied at least to a side of the basic substrate, said side facing away from the resin layer, by way of a printing method, and the lacquer layer is applied to only certain portions of the surface of the basic substrate, whereby regions with the lacquer layer and regions without the lacquer layer are produced on said surface.

8. The method according to claim 4, wherein after the lacquer layer has been applied, a transparent adhesion-promoter layer is applied to the lacquer layer in a layer thickness of 5 μm to 50 μm.

9. The method according to claim 8, wherein a decorative layer composed of a semiconductor is applied to the transparent adhesion-promoter layer by physical vapor deposition.

10. The method according to claim 9, wherein a non-transparent topcoat is applied to the decorative layer by a spraying method.

11. The method according to claim 1, wherein end-side surfaces of the basic substrate, which basic structure is provided with one or more layers, including the basic substrate, are sealed with a resin.

* * * * *